United States Patent [19]

Willis

[11] Patent Number: 4,813,536

[45] Date of Patent: Mar. 21, 1989

[54] PREASSEMBLED DISPLAY STAND AND CONTAINER

[76] Inventor: William T. Willis, 3638 Wentworth La., Lilburn, Ga. 30247

[21] Appl. No.: 72,627

[22] Filed: Jul. 13, 1987

[51] Int. Cl.[4] ..... B65D 5/52

[52] U.S. Cl. ..... 206/44 R; 206/45.25; 206/45.27; 206/45.3; 211/132; 248/174

[58] Field of Search ..... 206/44 R, 45.18, 45.19, 206/45.14, 45.2, 45.21–45.27, 45.28, 45.3; 248/174; 211/132

[56] References Cited

U.S. PATENT DOCUMENTS

| | | | |
|---|---|---|---|
| 1,576,731 | 3/1926 | Jack | 206/45.25 |
| 1,625,687 | 4/1927 | Ryan et al. . | |
| 1,850,020 | 3/1932 | Locke, Jr. . | |
| 1,992,069 | 2/1935 | Hasbrook . | |
| 2,028,522 | 1/1936 | Rice | 206/45.25 |
| 2,940,710 | 6/1960 | Adams . | |
| 3,021,042 | 2/1962 | Stumpf, Jr. | 248/174 |
| 3,567,014 | 3/1971 | Feigelman | 206/44 R |
| 3,692,174 | 9/1972 | Ross . | |
| 3,918,576 | 11/1975 | Taub . | |
| 4,191,288 | 3/1980 | Hostad . | |
| 4,197,939 | 4/1980 | Dogliotti . | |
| 4,411,382 | 10/1983 | Taub . | |
| 4,523,675 | 6/1985 | Schröter | 206/44 R |
| 4,579,220 | 4/1986 | Brundage | 206/45.3 X |
| 4,582,283 | 4/1986 | Schmitt | 248/174 |
| 4,651,871 | 3/1987 | Schröter | 206/44 R |

FOREIGN PATENT DOCUMENTS

| | | | |
|---|---|---|---|
| 0219176 | 4/1987 | European Pat. Off. | 206/45.24 |
| 2561089 | 9/1985 | France | 248/174 |

*Primary Examiner*—Stephen Marcus
*Assistant Examiner*—Bryon Gehman
*Attorney, Agent, or Firm*—Thomas & Kennedy

[57] ABSTRACT

A shipping container and display unit comprises a box shaped container for containing goods and a generally tubular stand hingedly attached to the bottom elevated position. The stand is adapted to collapse into a generally flat configuration and wrap around the outside of the container forming a compact package for shipping. An advertisement display panel having collapsible reinforcement wings is provided for displaying advertisement or other information about goods displayed in the container.

6 Claims, 2 Drawing Sheets

PREASSEMBLED DISPLAY STAND AND CONTAINER

BACKGROUND OF THE INVENTION

The present invention relates generally to shipping containers and particularly to shipping containers that serve as display stands for articles shipped therein.

It is common practice for manufacturers of small products to ship their products to retail stores in cardboard containers. At the retail store, the containers typically are cut open and the articles shipped therein are removed and placed onto shelves for display and sale. This is both a time consuming and wasteful process since the shipping containers, being designed for shipping only, are usually discarded after being unpacked. In addition, it is difficult to display advertisements or information about the products displayed on conventional shelves without hiding merchandise displayed on other shelves.

Previous attempts have been made to solve these problems through the use of shipping containers that also serve as display stands for merchandise shipped therein. Examples of such containers can be found in Taub U.S. Pat. No. 3,918,576, Hostad U.S. Pat. No. 4,191,288, and Ross U.S. Pat. No. 3,692,174. Each of these patents show shipping containers that also serve to display the goods shipped therein for sale. Each of them generally comprise a container in which the goods are shipped and a tubular stand for supporting the container in an elevated position above the floor or other surface. The Taub and Hostad patents also show display panels for displaying printed advertisements or other information.

While these containers are useful, they have not completely solved the problems discussed above. This is because they generally require assembly which can not only be intricate and frustrating, it can require at least as much time as removing the articles from the container and placing the articles on conventional shelves. In addition, the display panels for the containers do not have adequate means of vertical support and may droop or may be pulled over by customers.

SUMMARY OF THE INVENTION

Briefly described, the present invention comprises a shipping container which also serves as a display stand for merchandise shipped in the container. It has a generally hollow rectangular base or stand for supporting the container and articles in the container in an elevated position above a surface. The base is hingedly connected to the container and is adapted to collapse to a flat configuration and fold around the outside or periphery of the container and over the top of the container for shipping. The invention also includes a display panel that is adapted to fold across the top of the container for shipping. The display panel has foldable reinforcement wings for maintaining the panel in a rigid upright position when unfolded for display. The container may be maintained in its folded shipping configuration by a suitable means such as an ancillary box or wrapper of a suitable wrapping material such as cellophane.

To convert the invention from its packed, shipping and storage configuration to its display configuration, the outside wrapper or ancillary box is removed. This allows the folded stand to unfold under the influence of its own resiliency and gravity such that the container and goods therein can be mounted on and become supported atop the stand. The display panel also unfolds under the influence of its own resiliency. Reinforcement wings which are attached to the panel are folded out to 90° positions so as to urge the panel into a flat configuration.

Thus, it is an object of this invention to provide an improved shipping container that also serves as a display unit for goods shipped therein.

Another object of this invention is to provide a shipping container and display unit that has a stand that collapses to a flat configuration and wraps around the outside of the container and the goods within the container, forming a compact package for shipping.

Another object of this invention is to provide a shipping container and display unit with a stand portion that requires no assembly, erects itself automatically and supports the container and goods therein in an elevated position above the floor.

Still another object of this invention is to provide a shipping container and display unit having an advertisement display panel that has support wings for reinforcing the panel in an upright display configuration.

An additional object of this invention is to provide blanks to be cut from cardboard or the like from which a shipping container and display unit of the type described may be formed.

Other objects, features and advantages of the present invention will become apparent upon reading the following specification, when taken in conjunction with the accompanying drawings.

DETAILED DESCRIPTION

Figure 1:
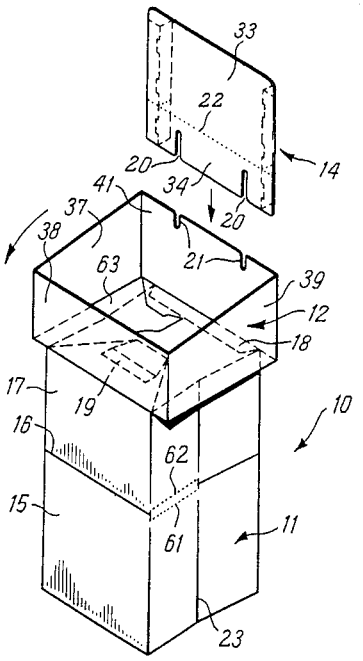
FIG. 1 is a perspective view of the invention in its unfolded display configuration, with the advertisement display panel displaced above the container to illustrate the connection therebetween.

Referring now in more detail to the drawings in which like numerals indicate like parts throughout the several views, FIG. 1 shows a shipping container and display stand 10, constructed in accordance with principles of the invention, as it appears in an unfolded display configuration. The display stand and container 10 has a generally rectangular open container 12 supported by a generally tubular or hollow rectangular stand 11. An advertising display panel or header 14 is releasibly attachable to the container 12. The container 12 is formed from a bottom panel 63 and conjoined side panels 37, 38, 39 and 41. In the embodiment illustrated in FIG. 1, side panel 38 serves as the front of the container and side panel 41 serves as the back of the container.

The back panel 41 of the container 12 has slots 21 formed in the top thereof. Slots 21 are adapted to mesh with the slots 20 formed in the bottom edge of the display panel 14 so that the display panel may be releasibly attached to the back panel of the container. The display panel 14 is scored along broken line 22 so that it may be folded across the top of the container and goods therein while releasibly attached to the back panel 41 forming a compact bundle for shipping.

Figure 3:
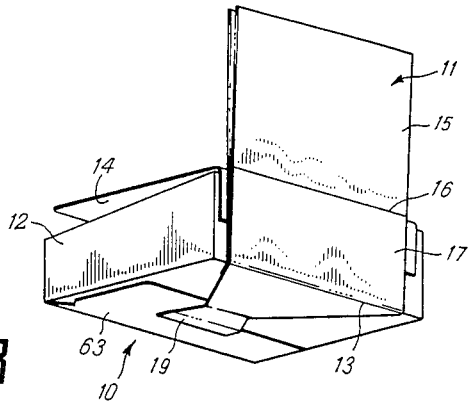
FIGS. 3 and 4 show the invention in progressively more unfolded configurations.

Stand member 11 has a front wall, a back wall, and side walls and is adapted, as will be discussed later, to be collapsed into a generally flat configuration and folded around and over the top of the container 12 for shipping. The bottom panel 63 is defined by four bottom forming flaps 64, 66, 67 and 68 (FIG. 8) which are hingedly attached to the bottom edges of the side panels and folded inwardy 90° to define the bottom panel 63. The stand 11 is hingedly attached with, for example, glue to the bottom 63 of the container 12 via attachment tabs 18 and 19. As best seen in FIG. 3, attachment tab 18 in the preferred embodiment is attached to bottom forming flap 68 adjacent the back panel 41 and attachment tab 19 is attached to bottom forming flap 66 intermediate the front and back of the container.

Figure 2:
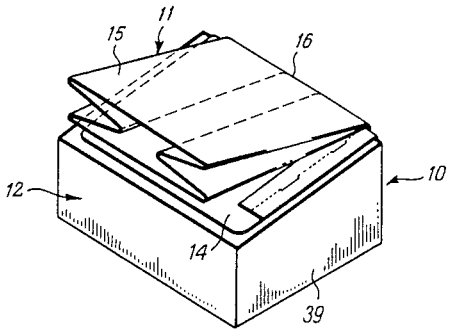
FIG. 2 is a perspective view of the invention in its folded shipping configuration.

FIG. 2 shows the shipping container and display stand 10 as it appears in its folded shipping configuration. The display panel 14 is shown folded along line 22 across the top of the container 12. The stand 11 is shown collapsed to a generally flat configuration and wrapped around the back side of the container and over the top thereof forming a compact box-like structure for shipping.

Figure 4:
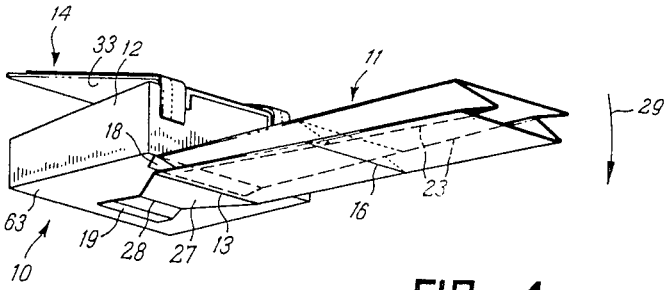

FIGS. 3 and 4 show the shipping container and display stand 10 as it appears in two stages of unfolding from the shipping configuration of FIG. 2 to the display configuration of FIG. 1. These figures more clearly illustrate how the stand 11 is adapted to be collapsed and folded around the container 12 for shipping. The front wall of the stand 11 has an elongated panel 27 which extends from the top edge of the front wall and connects to the bottom forming flap 68 of the bottom 63 of the container 12 via a connecting tab 19. The panel 27 acts to force the stand open as it is unwrapped from the container as will be described in more detail below.

Figure 5:
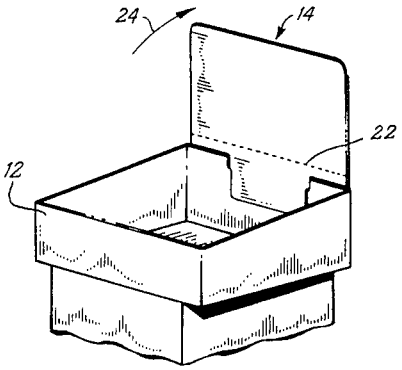
FIG. 5 is a partial perspective of the invention showing the display panel attached thereto.
Figure 6:
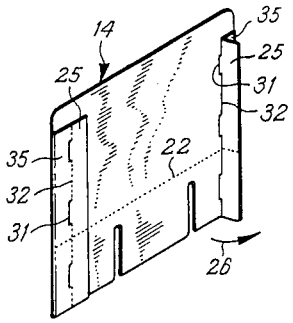
FIG. 6 is a perspective view of the rear of the display panel showing the reinforcement wings.

FIGS. 5 and 6 illustrate the construction of the advertising display panel 14. FIG. 5 shows the display panel 14 attached to the back of the container 12 and unfolded along broken line 22 to a generally upright position. FIG. 6 is a perspective view of the back of the display panel 14 showing the support wings for reinforcing the display panel so that it remains in an upright rigid position after being unfolded. The support wings are formed from a strip of material that is scored for folding along broken line 32. The broken line defines an attachment tab 35 and a wing 25. The attachment tab is folded along line 36 so that it is contiguous with panel 33 and firmly connected to the back of the display panel in a conventional manner such as gluing. Alternatively, tabs 35 may be separate from display panel 33 and connected thereto by gluing. The wings 25 have pressure tabs 31 formed along broken line 32 so that when a wing 25 is swung outwardly along broken line 32 in the direction indicated by numeral 26, the pressure tabs 31 come to rest firmly against the back of the display panel maintaining the wing 25 in a generally perpendicular relationship with respect to the display panel and reinforcing the display panel. Thus, when the wings 25 are pivoted outwardly as shown in FIG. 6, they provide reinforcement and support for the display panel such that it does not droop and cannot easily be pulled over.

Figure 7:
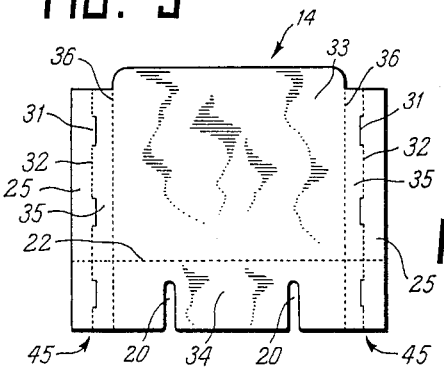
FIG. 7 is a plan view of a blank from which the display panel may be formed.
Figure 8:
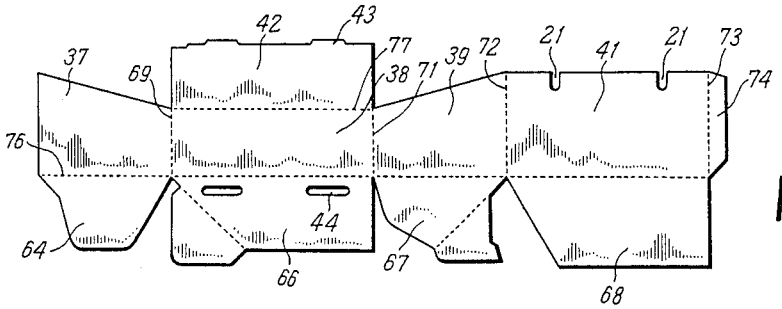
FIG. 8 is a plan view of a blank from which the container portion of the invention may be formed.
Figure 9:
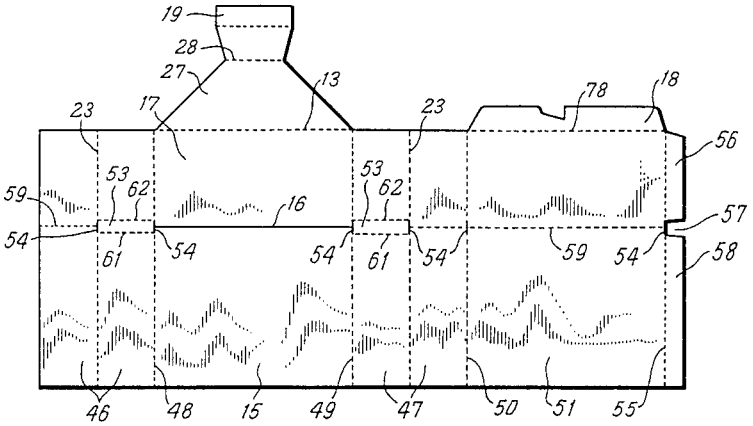
FIG. 9 is a plan view of a blank from which the stand portion of the invention may be formed.

FIGS. 7 through 9 illustrate blanks of cardboard or other suitable material from which the display panel, container and stand described above may be formed. The display panel blank of FIG. 7 is seen to have a fold line 22 which defines an upper panel portion 33 and a lower panel portion 34. The lower panel portion 34 has slots 20 formed therein for releasibly fastening the display panel to the container as discussed above. Disposed on opposite sides of the upper and lower panel portions and connected thereto along fold lines 36 are reinforcement panels 45. Each reinforcement panel comprises an attachment tab 35 and a support wing 25 connected together at fold line 32. Each support wing has three pressure tabs 31 along fold line 32 which extend partially into attachment tab 35. The pressure tabs 31 are formed by through scoring the cardboard around the edges of the tabs so that when the support wing 25 is folded along fold line 32, pressure tabs 31 remain coplanar with support wings 25.

FIG. 8 illustrates a blank from which the display container may be formed. It is seen to have a back panel 41, a front panel 38, and two side panels 37 and 39. Connected to the front, back and side panels are a series of tabs 64, 66, 67 and 68. These tabs are of a size and shape such that when the blank is folded to form the container and the tabs are folded along fold line 76, they mesh together to form the bottom panel 63 of the container. An inner front panel 42 is connected along fold line 77 to front panel 38. The inner front panel 42 has a pair of securing tabs 43 and tab 66 has a pair of matching slots 44. The tabs 43 and slots 44 are adapted to couple together when tab 66 is folded along fold line 76 to a generally perpendicular relationship with respect to the front side 38 and inner front panel 42 is folded along fold line 44 such that it is adjacent the front side 38 on the inside of the container. Back panel 41 has slots 21 formed along the top edge thereof for coupling with slots 20 in the display panel 14 allowing the display panel to be releasibly attached to the backside of the container. Flange 74 is connected to the edge of back panel 41 and is adapted to be attached to the edge of side panel 37 when the blank is folded to form the container.

A blank from which the stand may be formed is shown in FIG. 9. It has a lower front panel 17 and an upper front panel 17 separated by through score 16. Connected along fold line 13 to the upper front panel 17 is elongated panel 27 which terminates at its upper extend in the attachment tab 19.

Connected to the upper and lower front panels along fold lines 48 and 49 are stand side panels 46 and 47. Each of the side panels is longitudinally bisected by fold line 23 to form a front portion having double transverse fold lines 61 and 62, and a back portion having a single transverse fold line 59.

Connected along fold line 50 to side panel 47 is a back panel having an upper portion 52 and a lower portion 51 separated by a horizontal fold line 59. Connected along fold line 78 to the top edge of upper back panel 52 is attachment tab 18. Attached along fold line 55 to the outermost edge of the back panel are upper and lower connecting tabs 56 and 58 separated by slot 57. This connecting tab is adapted to be attached to the outermost edge of side panel 46 when the blank of FIG. 9 is folded to form the stand. Through scores 54 are formed at the points on the front and side panels where horizontal and vertical fold lines intersect. These small through scores facilitate the folding of the assembled stand around the container when it has been compressed to its generally flat configuration.

OPERATION

The operation of the present invention will be described first in terms of the forming of the shipping container and display stand from the blanks of FIGS. 7 through 9 and then in terms of the operation of the assembled display stand and container.

To form the display panel 14 from the blank of FIG. 7, glue is applied to attachment tabs 35 and the tabs are folded along lines 36 until they are contiguous with and attach via the glue to the upper and lower panels 33 and 34. Care must be taken not to allow the glue to spread onto support wings 25 as they must be free to hinge outwardly along fold lines 32 to reinforce the display panel.

In the formation of the container from the blank of FIG. 8, the front, back and side panels 38, 41, 37, and 39 are folded inwardly along fold lines 69, 71, and 72 forming a generally hollow rectangular shape. Tab 74 is folded along fold line 73 and attached with glue or other suitable attaching means to the free edge of side panel 37. The bottom forming tabs 64, 66, 67, and 68 are folded inwardly along fold line 76 so as to form the bottom panel of the container. Finally, the inner front tab 42 is folded inwardly along fold line 77 so that it is contiguous with front panel 38 and locking tabs 43 are coupled with slots 44 to maintain inner front panel 42 in its folded configuration. The generally rectangular open container 12 shown in FIG. 1 is thus formed from the blank of FIG. 8.

To form the stand portion of the present invention, the front, back and side panels in FIG. 9 are folded inwardy along fold lines 48, 49, and 50 to form a generally hollow rectangular stand. Tabs 56 and 58 are folded inwardly along fold line 55 and glued or otherwise attached to the free edge of side panel 46. The attachment tabs 18 and 19 are then firmly attached to bottom forming flaps 68 and 66, respectively to form the combination shipping container and display stand.

The operation of the assembled display stand and container can best be understood by reference to FIGS. 1–4. The shipping container and display stand is received at the retail store, packed with goods to be sold, in its shipping configuration shown in FIG. 2. It will be understood that in FIG. 2, the outer shipping carton or wrapping has been removed from the assembly. In the configuration of FIG. 2, a store clerk need only hold the container 12 above the floor by grasping sides 37 and 39. The stand portion of the invention will tend to unfold under the influence of the natural resiliency of the cardboard first to the configuration of FIG. 3, then to that of FIG. 4, and finally to the fully opened display configuration of FIG. 1. As the stand 11 unfolds from the configuration of FIG. 4 to that of FIG. 1, the front portion of the stand is forced outwardly by the lever action of the tab 27 so that the stand opens as it unfolds as shown.

With the container 12 supported atop stand 11, the support wings 25 are folded outwardly along fold line 32 as shown in FIG. 6. This causes pressure tabs 31 to rest firmly against the back of the display panel 14 so that the display panel is reinforced and maintained in its upright vertical configuration.

It is thus seen that an improved shipping container and display stand is now provided that is of integral construction and that requires no assembly of the stand prior to display. The stand portion folds compactly around the container and over the top thereof for shipping. When received at the retail store, the stand automatically erects itself under the influence of its own resiliency and gravity so that only a few seconds of a store clerk's time is required. The advertising display panel is releasibly attachable to the back of the container and has reinforcment wings so that it will not droop and cannot easily be pulled over by customers.

I claim:

1. A shipping container comprising conjoined front, back, side and bottom panels with said bottom panel being defined by a plurality of bottom forming flaps each hingedly attached to one of said front, back and side panels along the bottom edges of said panels, and support means hingedly attached to said flaps for supporting said container in an elevated position above a surface, said support means being adapted to collapse to a generally flat configuration and wrap around a periphery of said container, said support means comprising:

front, back and side walls joined to form a generally rectangular open ended stand having an open top end portion and an open bottom end portion, said side walls including vertical fold lines formed therein;

said back wall being hingedly attached along its top edge portion to one of said bottom forming flaps of said container adjacent said back panel;

an elongated tab having a first end and a second end, said elongated tab being hingedly attached at its first end to the top edge portion of said front wall and hingedly attached at its second end to another one of said bottom forming flaps of said container remote from said back panel;

said elongated tab being adapted to fold inwardly along a transverse fold line located between said first and second ends as said stand unwraps from the periphery of said container so that said front wall is urged by said folding tab away from said back wall causing said support means to unfold from its generally flat configuration to its open support stand configuration;

said side walls being adapted to fold inwardly along said vertical fold lines so that said stand can be collapsed in a direction from the front of the stand to the back thereof into a generally flat configuration; and said stand, when collapsed, being adapted to wrap around the periphery of the container as defined by its bottom, back and open top.

2. A shipping container comprising conjoined front, back, side and bottom panels, a display panel having a top end portion and a bottom end portion and being hingedly attached at its bottom end portion to the top edge of said back panel, and means for reinforcing said display panel when said display panel is in an upright position, said reinforcing means comprising at least one support wing, hinge means attaching said support wing to the back of said display panel so that said support wing is pivotable between a closed position parallel to said display panel and an open position extending at a right angle with respect to said display panel, means for maintaining said wing in its open position comprising at least one pressure tab formed along said hinge means, said pressure tab being positioned to move into firm engagement with the display panel as said wing is pivoted toward its open position.

3. A display stand comprising:

a shipping container having conjoined front, back, side and bottom panels;

a support stand hingedly attached to the bottom panel of said shipping container on the outside thereof for supporting said shipping container in an elevated position above a surface, said support stand being adapted to collapse to a generally flat configuration and wrap around the periphery of said shipping container;

a display panel having a top end and a bottom end and being hingedly attached at its bottom end to the top edge of the back panel of said shipping container, and means for reinforcing said display panel when the display panel is in an upright position;

said support stand comprising front, back, and side walls joined to form a generally tubular stand having a top end and a bottom end;

said back wall of said support stand being hingedly attached along its top edge to the container bottom panel adjacent the container back panel;

an elongated tab having a first end and a second end, said elongated tab being hingedly attached at its first end to the top edge of the front wall of said support stand and hingedly attached at its second end to said shipping container bottom panel;

said elongated tab being adapted to fold along a transverse line located between the first and second ends of said elongated tab as said support stand unwraps from the periphery of said container so that the front wall of said support stand is urged by said folding tab away from the back wall of said support stand causing said support stand to unfold from its generally flat configuration to its generally tubular stand configuration;

said means for reinforcing said display panel comprising at least one support wing hingedly attached along a line to the back of said display panel, said support wing having an open and a closed position and having at least one pressure tab formed along its line of hinged attachment, said pressure tab being movable into firm engagement with the display panel when said wing is in its open position.

4. A blank for use in forming an advertising display panel of the type used with a shipping container and display unit, said blank comprising a generally rectangular panel having opposed first and second edges and opposed third and fourth edges, a first elongated flap foldably connected along a longitudinal edge to said third edge of said panel and a second elongated flap foldably connected along a longitudinal edge to the fourth edge of said panel, each of said elongated flaps having a longitudinal fold line scored therein defining a first portion of said flap adjacent said panel and a second portion of said flap displaced from said panel, said second portion having at least one rectangular locking tab struck therefrom and formed along said fold line extending from said second portion of said flap across said fold line into said first portion of said flap, and a fold line extending laterally across said panel and said flaps.

5. A shipping container comprising a box structure having conjoined front, back, side, and bottom panels;

a foldable support stand comprising opposed front and back walls connected by opposed accordion foldable side walls, said back wall being hingedly connected to said box structure bottom panel adjacent the back panel;

an elongated panel including a fold line intermediate its ends and being connected at one of its ends to the front wall of said foldable support stand and connected at its other end to the bottom panel of said box structure, said elongated panel having first and second positions for urging the front wall of said foldable support stand to a position adjacent the back wall of said foldable support stand with said side walls folded to form a generally flat configuration of said foldable support stand in its first position and for urging said front wall of said foldable support stand away from its rear wall with said side walls unfolded to form a generally rectangular configuration of said stand in said second position;

said foldable support stand, when said front wall is positioned adjacent said rear wall, being adapted to wrap around the periphery of said box structure forming a compact bundle for shipping; and an advertising display panel releasibly connected to the top edge of the back panel of said box structure, said display panel including at least one support wing hingedly attached thereto and having an opened and a closed position; and means for maintaining said wing in its open position comprising at least one pressure tab formed along the hinged attachment of said support wing to said display panel, said pressure tab being in firm engagement with said display panel when said support wing is in its open position.

6. A shipping container for shipping goods to and displaying goods at a retail store or the like, the combination therewith of an advertising display panel mounted to said shipping container, said display panel including at least one support wing, hinge means attaching said support wing to said shipping container so that said support wing is pivotable between a closed position parallel to said display panel and an open position extending at an angle with respect to said display panel, means for maintaining said support wing in its open position comprising a protrusion extending from said support wing toward engagement with said display panel when said support wing is in its open position, and a common fold line formed across said display panel and said support wing when said support wing is in its closed position, whereby when said support wing is closed, said display panel and said support wing can be folded along their common fold line into overlying relation with respect to said shipping container and can be unfolded along their common fold line to an approximately upright attitude and said support wing pivoted to an open position to maintain the display panel unfolded.

* * * * *